United States Patent [19]

Maternaghan

[11] 4,150,994

[45] Apr. 24, 1979

[54] PROCESS FOR THE MANUFACTURE OF PHOTOGRAPHIC SILVER HALIDE EMULSIONS CONTAINING SILVER HALIDE CRYSTALS OF THE TWINNED TYPE

[75] Inventor: Trevor J. Maternaghan, Brentwood, England

[73] Assignee: Ciba-Geigy AG, Basel, Switzerland

[21] Appl. No.: 799,040

[22] Filed: May 20, 1977

[30] Foreign Application Priority Data

Jun. 10, 1976 [GB] United Kingdom ..... 24001/76

[51] Int. Cl.[2] ..... G03C 1/02; G03C 1/28

[52] U.S. Cl. ..... 96/94 R; 96/108

[58] Field of Search ..... 96/94 R, 108

[56] References Cited

U.S. PATENT DOCUMENTS

| | | | |
|---|---|---|---|
| 2,592,250 | 5/1952 | Davey et al. | 96/94 R |
| 3,482,982 | 12/1969 | Michatal | 96/94 R |
| 3,573,057 | 3/1957 | Stevens | 96/94 R X |
| 3,655,394 | 4/1972 | Illingsworth | 96/108 |
| 3,773,516 | 11/1973 | Gutoff | 96/94 R |
| 3,782,954 | 1/1974 | Porter et al. | 96/94 R |
| 3,790,387 | 2/1977 | Munslinger | 96/94 R |
| 3,821,002 | 6/1974 | Culhane et al. | 96/94 R |
| 3,917,485 | 11/1975 | Morgan | 96/94 R X |
| 3,957,490 | 5/1976 | Libeer et al. | 96/94 R |

FOREIGN PATENT DOCUMENTS

| | | | |
|---|---|---|---|
| 1335925 | 10/1973 | United Kingdom | 96/94 R |
| 1469480 | 4/1977 | United Kingdom | 96/94 R |

*Primary Examiner*—Edward C. Kimlin
*Assistant Examiner*—Alfonso T. Suro Pico
*Attorney, Agent, or Firm*—Sprung, Felfe, Horn, Lynch & Kramer

[57] ABSTRACT

A method of preparing photographic silver iodobromide or iodochloride emulsions the silver halide crystals of which are of the twinned octahedral or cubic type, which emulsions have improved homogeneity of iodide content and controlled size distribution of the crystal grains, comprising the following steps:

(a) Forming a monosized silver iodide dispersion in gelatin;

(b) Mixing in the silver iodide dispersion aqueous solutions of silver nitrate and alkali metal or ammonium bromides or chlorides in order to form twinned crystals;

(c) Performing Ostwald ripening in the presence of ammonia solution and a controlled silver ion concentration to increase the size of the twinned crystals and dissolve any untwinned crystals;

(d) Optionally increasing the size of the twinned crystals by the further addition of silver and halide ions; and (e) Chemically sensitising the emulsion.

The new photographic emulsions exhibit a high covering power and contrast on development.

21 Claims, 12 Drawing Figures

Figure 10:
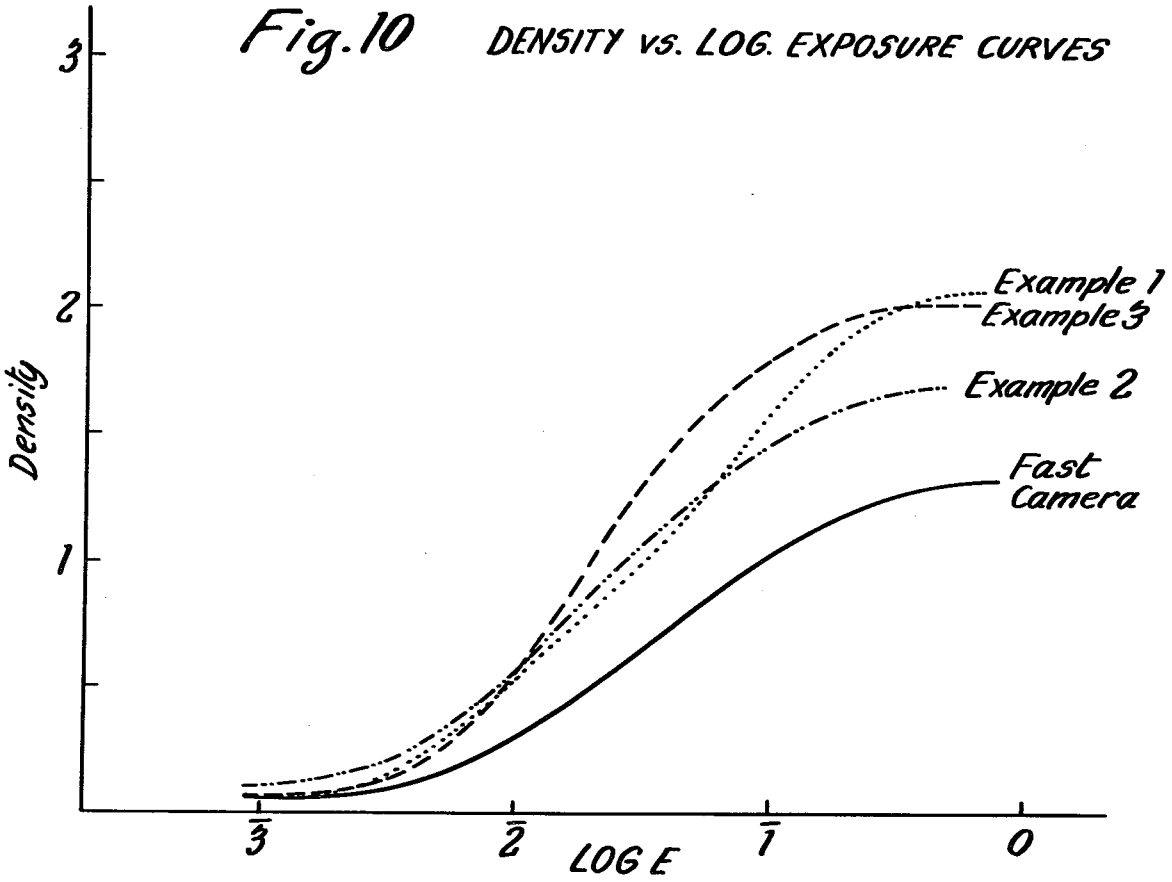

Fig. 10 DENSITY VS. LOG. EXPOSURE CURVES

PROCESS FOR THE MANUFACTURE OF PHOTOGRAPHIC SILVER HALIDE EMULSIONS CONTAINING SILVER HALIDE CRYSTALS OF THE TWINNED TYPE

This invention relates to a process for the production of improved photographic silver halide emulsions and to the photographic emulsions obtained.

Silver halide emulsions are composed of silver halide crystals dispersed in a colloid medium which is often gelatin. The properties of photographic emulsions are dependent on several factors. These are the size and size distribution of the silver halide crystals; the shape and crystal habit of the crystals (external lattice faces and extent of twinning); the halide make-up of the crystals and other factors for example the degree of chemical sensitisation and the presene of additives in the emulsion e.g. optical sensitising dyes. By judicial selection involving each of these factors emulsions having the requisite photographic properties may be obtained. This invention relates especially to silver halide crystals which are of particular shape and habit. However in order to achieve this selection of shape and habit it has been found necessary that some restriction of the halide composition is also required. Specifically, this invention relates to an improved method for the production of silver iodobromide, silver iodochloride or silver iodochlorobromide emulsions of the twinned type by a controlled incorporation of silver iodide in the silver halide crystals during growth.

Improved photographic properties are often observed when a mixture of water-soluble halides is used in the precipitation of the silver halide; for example in the single-jet process in which aqueous silver nitrate is added to a solution containing a small amount of gelatin and a mixture of soluble halides. One advantage of the single-jet procedure over the alternative double-jet process, in which aqueous solutions of silver nitrate and soluble halide salts are added simultaneously to a stirred solution of gelatin, is that the emulsion crystals produced are predominantly twinned octahedral crystals as they are nucleated in an excess of halide ions. This is especially true in the case of iodobromide precipitations. A description of twinned crystals is given in "An introduction to crystallography," 3rd edition, Longmans (1966) pp 162–165 by F. C. Phillips and "The crystalline state," by P. Gay, Oliver and Boyd (1972) pp 328–338. The disadvantage of such a single-jet process is that the twinned crystals produced invariably have a relatively wide size distribution.

Figure 1:
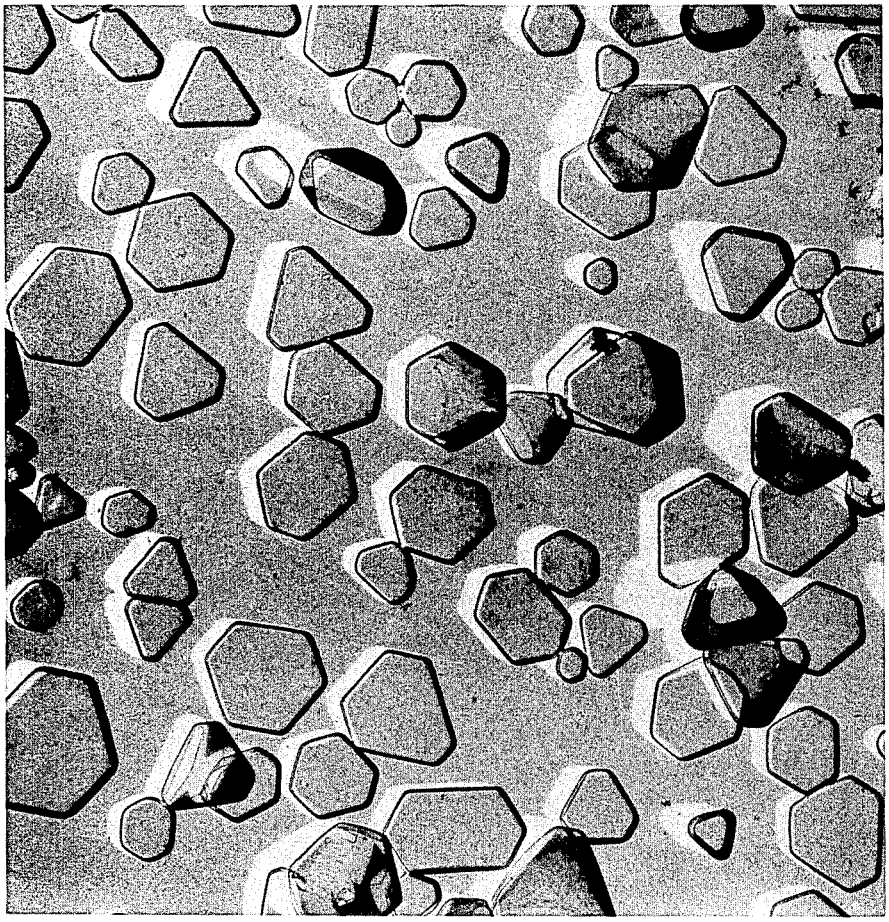

Silver halide crystals of flat or tabular shape exhibit on development extremely good covering power and thus the silver utilisation is extremely good compared with silver halide crystals of other shapes for example cubic crystals. Many twinned octahedral crystals are of this type particularly if the crystals contain more than one twin-plane and the twin planes are parallel. FIG. 1 shows silver halide crystals of the tabular twinned type. A particular object of the present invention is to increase the proportion of twinned crystals with parallel twin planes in an emulsion.

Another objective of improvements in the commercial production of photographic emulsions is to increase the contrast of the final material, this being a desirable property for graphic arts and radiographic products. This may be achieved partly as a result of a decrease in size distribution, as for example described in British patent specification no. 1469480, and partly by ensuring that the iodide content and iodide distribution of different silver halide crystals in the emulsion are made more similar. The point of addition of the soluble iodide salt in various emulsification processes is known to affect the sensitivity and size distribution of the emulsion (Research Disclosure no. 13452 (1975)).

Thus the application of photographic emulsions containing twinned crystals to products requiring enhanced sensitivity and contrast has been hindered by the defects of conventional emulsification procedures particularly the uncontrolled incorporation of iodide in the crystals. We have discovered an improved method for the preparation of silver iodobromide, silver iodochloride or silver iodochlorobromide photographic emulsions, wherein iodide ions are supplied to the growing crystals by the dissolution of a uniform dispersion of silver iodide crystals. Also we have found the conditions under which the desired tabular twinned habit is favoured by this process, and by which substantially uniform photographic emulsion crystals of this type may be prepared.

According to the present invention there is provided a method of preparing a silver halide emulsion containing silver halide crystals of the twinned type which comprises the steps of (a) forming in a colloid dispersing medium silver halide crystals containing at least 90 mole % iodide, (b) mixing in the dispersing medium containing the said silver halide crystals an aqueous solution of a silver salt and an aqueous solution of an alkali metal or ammonium bromide or chloride or mixtures thereof so forming twinned silver halide crystals containing iodide and the halide or halides being added, (c) adding a silver halide solvent to the dispersing medium and so causing the growth of the twinned crystals by Ostwald ripening and optionally (d) then causing the twinned crystals to increase in size by adding to the colloidal dispersion further aqueous silver salt solution and further alkali metal or ammonium halide and then finally optionally (e) removing the water-soluble salts formed and chemically sensitising the emulsion.

By Ostwald ripening is meant the dissolution of the smaller more-soluble crystals, the silver halide depositing on the larger less-soluble crystals. In the process of this invention usually the smaller more-soluble crystals contain less iodide than the larger less-soluble crystals.

Thus in the process of the present invention silver halide crystals of high iodide content are first formed. Silver halide crystals which have a high iodide content (i.e. 90–100 mole % iodide) are predominantly of the hexagonal lattice structure (and have the crystal form shown in FIG. 2) whereas silver halide crystals containing smaller amounts of iodide (i.e. up to approximately 45 mole % iodide) are predominantly of the face-centred lattice structure (and may have the crystal form shown in FIG. 1). In step (b) in which silver nitrate and water-soluble bromide or chloride are added growth on to the existing silver iodide crystals can not take place and thus nuclei of silver halide of the face-centred cubic lattice type are formed. During this step the silver iodide crystals dissolve and iodide is incorporated into the growing silver halide crystals of the face-centred cubic lattice type. The supply of iodide ions in step (b) hereinafter called the recrystallisation step is provided by further dissolution of the silver iodide crystals to maintain the equilibrium concentration given by the relationship $$[Ag^+][I^-]=K$$

where [Ag+], [I−] are the activities (in dilute solution the concentrations) of silver and iodide ions, and k is a constant (k is the well-known solubility product).

The incorporation of iodide in the growing crystals in step (b) encourages the formation of octahedral faces, and in particular, the formation of stacking faults known as twin planes. Moreover, in one aspect of the present invention the formation of crystals which parallel twin planes is especially favoured. This results in a modification of crystal shape, so that many of the crystals formed are of the tabular twinned type illustrated in FIG. 1. It is known that the formation of twin planes is not possible when the external faces of the crystals are the cubic (100) lattice planes (Berry and Skillman Photographic Science and Engineering 6, page 159 (1962)), but can occur only when the external faces comprise at least partially the octahedral (111) lattice planes. Thus the incorporation of iodide in the recrystallisation step (b) has the effect of encouraging twin formation, even under conditions where, with crystals containing no iodide, cubic external faces are normally displayed.

In step (b) as iodide ions are removed from the solution phase by precipitation, they are rapidly replaced by the dissolution of further silver iodide crystals, so that depending on the addition rates of the silver and halide solutions the silver iodide crystals are completely dissolved by the end of the precipitation or recrystallisation step (b). It is believed that by Ostwald ripening in the presence of a silver halide solvent such as ammonia, ammonium bromide or ammonium thiocycanate in step (c), silver halide is deposited on the less-soluble crystals of high iodide content, which are predominantly twinned, by the dissolution and diffusion from the more-soluble small crystals of low iodide content which are predominantly untwinned.

Preferably the Ostwald ripening step is carried out under conditions favouring the production of octahedral faces so that selective growth of twinned crystals is favoured. Thereafter, if desired, the conditions may be changed to favour cubic faces especially in step (d), with the consequent formation of twinned cubic crystals.

However the silver halide crystals of the photographic emulsion produced by the process of the present invention can be predominantly of the desirable tabular twinned type when the growth step (d) or the Ostwald ripening step (c) is carried out in conditions favouring the octahedral habit and usually more than 50% by weight or number of the silver halide crystals present are of this type under these conditions.

Preferably, the recrystallisation step (b) in which the twinned crystals are nucleated is effected by the addition of aqueous 3M–5M solutions of silver nitrate and ammonium bromide or chloride or mixtures thereof to a stirred dispersion of silver iodide in gelatin solution, at a fixed temperature and pAg value maintained in the range 5.0 to 11.0, and most preferably in the range 6.0 to 10.0. The fixed temperature may be set within a wide range e.g. 35° to 90° C. It is most advantageous to maintain the flow rate of the silver nitrate solution constant during this stage with the necessary adjustments made to the addition rate of the halide solution. It is to be understood that steps (a) and (b) need not follow directly one after the other. For example the silver iodide colloid dispersion may be made before required and the stored. Further it is possible to commence step (c) before the completion of step (b). In such case a silver halide solvent such as ammonia may be added with the fresh halide solution after part of the halide has been added to form the twinned silver halide crystals. If fairly small silver halide crystals are required then step (d) may not be necessary. However step (d) is of particular use in the production of monosized twinned silver halide emulsions as hereinafter described.

Preferably in step (a) pure silver iodide crystals are formed but up to 10 mole % of other halides (chloride or bromide) may be present in the silver iodide crystals while still retaining their hexagonal lattice form. Thus it is to be understood that the term silver iodide crystals includes crystals containing up to 10 mole % of other halides. It is to be understood that a small fraction of the crystals formed (i.e. up to 10% by weight or number of the crystals) in step (a) may be of the face-centred cubic lattice type without marked effect on the process according to the invention. Preferably in step (b) no additional iodide is added in the halide solution, but the possibility of adding small amounts is not excluded (i.e. up to 10 mole % of the halide added in this step may be iodide).

It is preferred that the median linear size of the silver iodide crystals formed in step (a) should be in the range 0.05–0.5 microns and most preferably in the range 0.1–0.4 microns.

It is preferred that the silver iodide content in the dispersing medium at the commencement of step (b) should be in the range 0.05–2.0 moles/liter and most preferably in the range 0.10–1.0 moles/liter.

It is a particular feature of the present invention that in order to prepare a crystal population of the highest uniformity in step (b) which may be used to prepare monosized emulsions, the addition rates of the silver halide solutions added in step (b) should be constant and predetermined by experiment. The optimum flow rates in this respect depend on the nature of the halide, the number of silver iodide crystals in the aqueous dispersion medium, the crystal size of the silver iodide crystals, the pAg in the range specified above, and the temperature. For example higher rates of addition are required in the preparation of silver iodochloride or silver iodochlorobromide emulsions than in their silver iodobromide equivalents.

Figure 3:
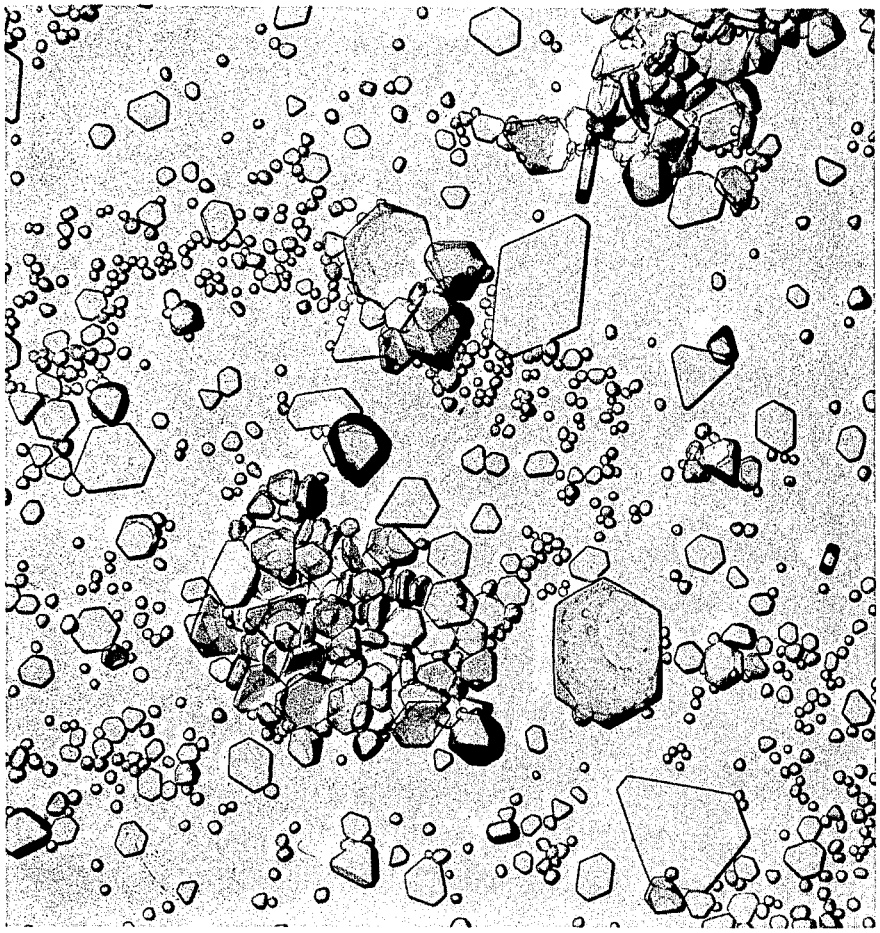
Figure 4:
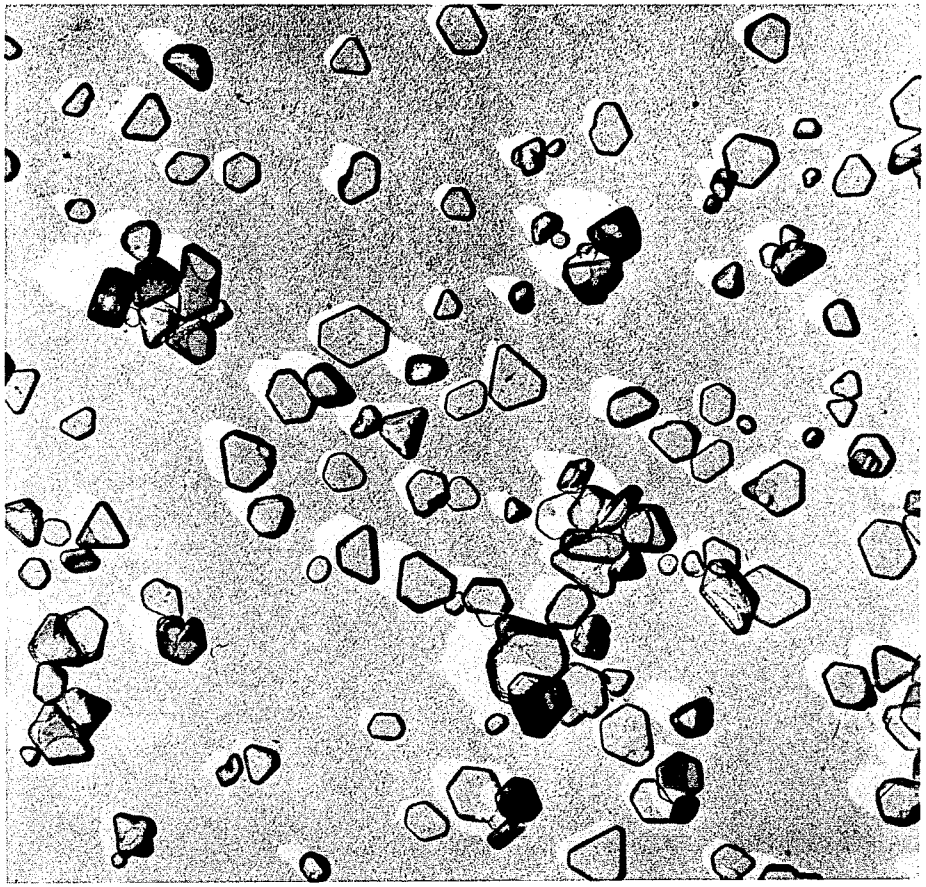
Figure 5:
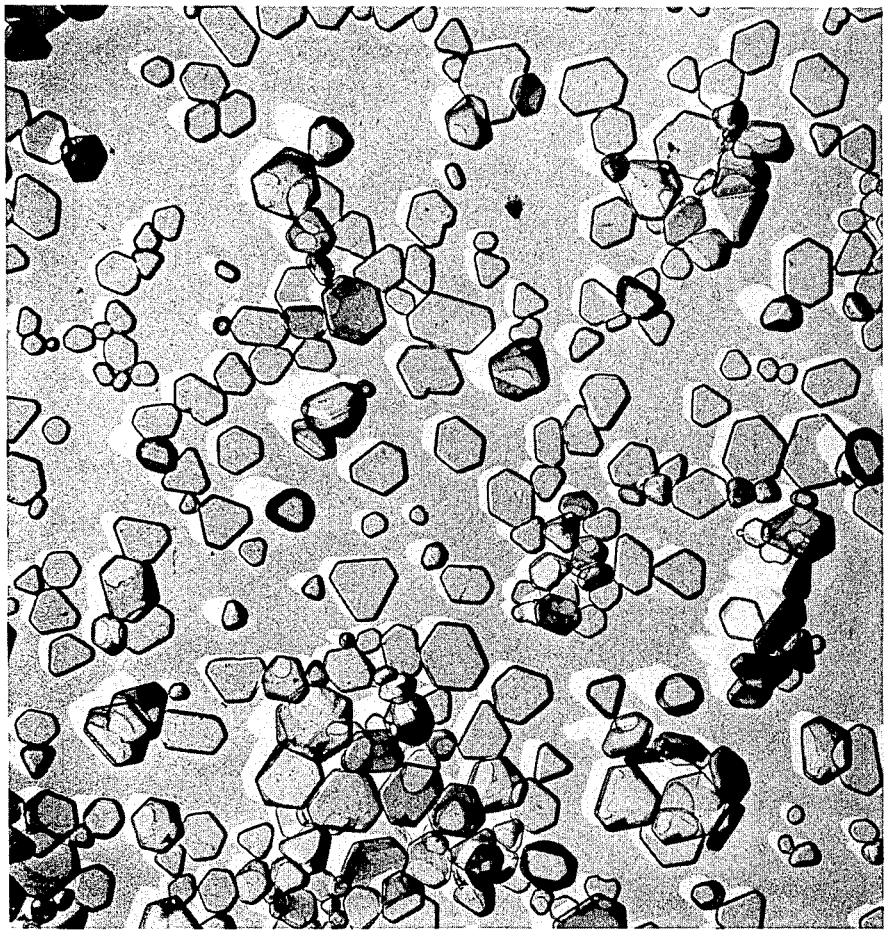

It is preferred in the recrystallisation step (b) that the volumes of silver nitrate and ammonium or alkali metal halides added should be such that the silver iodide comprises from 0.01–20 mole % of the total silver halide in the final emulsion. As a guide to the appropriate flow rate to be employed in this step, the solutions should be added at such a rate that a quantity of silver nitrate chemically equivalent to the silver iodide is introduced within a time period between 5 seconds and 10 minutes from the commencement of precipitation. As a further indication of the appropriate flow rate the rate should be adjusted until the dissolution of the silver iodide is substantially complete by the time at which a quantity of silver nitrate one to three times that equivalent to the silver iodide has been added. The optimum rate can thus be deduced from electron micrographs taken at different times during the recrystallisation, as the distinctive crystal habit of the silver iodide crystals allows them to be differentiated from silver halide crystals of the usual face-centred cubic lattice. Electron micrographs of the final ripened emulsion can give yet another indication of the optimum flow rates. FIG. 3 shows the resulting emulsion in the case of excessively low addition rates, and FIG. 4 shows the emulsion resulting from excessively high addition rates. In FIG. 3 undissolved crystals of silver iodide may be distinguished and the twinned crystals are relatively large indicating that the recrystallisation of the silver iodide was incomplete and hence relatively few twins were formed and these were consequently large on ripening. FIG. 4 shows relatively thick, complex twins resulting from an excessively rapid dissolution of the silver iodide and therefore insubstantial influence on the formation of the crystals during the recrystallisation step. These figures should be compared with FIG. 5, which illustrates the formation of a population of twinned crystals more uniform in size and shape, resulting from the selection of an appropriate, intermediate rate of addition during step (b).

In order that ripening occurs at a conveniently fast rate during step (c), it is necessary to add silver halide solvents such as an excess of halide salts or ammonia, or other silver halide complexing agents such as ammonium thiocyanate. The relative concentration of solvents affects the crystal habit observed after ripening. The effect of excess bromide and ammonia in Ostwald ripening on the habit of silver iodobromide crystals is described by Marcocki and Zaleski (Phot. Sci. Eng. 17, 289 (1973)); the effect of a slight excess of bromide is to favour the formation of the octahedral habit.

The Ostwald ripening in step (c) of the present invention is most preferably carried out in conditions favouring octahedral habit. The preferred silver halide solvent is ammonia, added to a final concentration in the range 0.1–1.5 M, and the preferred temperature for the ripening is between 50°–70° C. The preferred pAg value for the ripening stage is in the range 7–10. Excessively high temperatures or halide or ammonia concentrations usually result in a widening of the final size distribution.

A high concentration of ammonia encourages the formation of the cubic habit in silver iodobromide crystals, and for this reason it is preferred that the recrystallisation step (b) for silver iodobromide emulsions should be carried out in a low concentration of ammonia. Conversely for silver iodochloride or silver chloride crystals, a high concentration of ammonia encourages the formation of the octahedral habit (Berg et al, Die Grundlagen der photographischen Prozesse mit Silberhalogeniden Band 2 p. 640) and therefore the recrystallisation and ripening steps (b) and (c) for silver iodochloride emulsions according to the present invention should be carried out at an ammonia concentration within a preferred range of 0.5–1.5 M throughout. This is most conveniently achieved by the addition of a concentrated ammonia solution to the alkali metal or ammonium chloride solution.

Similarly within the scope of the present invention twinned photographic emulsions of the intermediate tetradecahedral habit may be produced by selection of the appropriate solution conditions.

The process of the present invention is particularly suitable for the production of twinned silver halide emulsions of the monosized type. In this aspect of the invention step (d) is included and during this step further silver and halide solutions are added by a double-jetting method and at a controlled pAg. Preferably the additional halide added during this stage is such that the iodide content of the final crystals is about 1 to 10 mole % which is the amount of iodide which has been found to be most beneficial yielding high-speed emulsions which exhibit rapid development.

A method of preparing monosized twinned octahedral silver halide crystals is described in British patent specification no. 1469480 and the silver halide crystals produced after step (c) in the process of this invention can be caused to increase in size following the method described in British patent no. 1469480.

Figure 6:
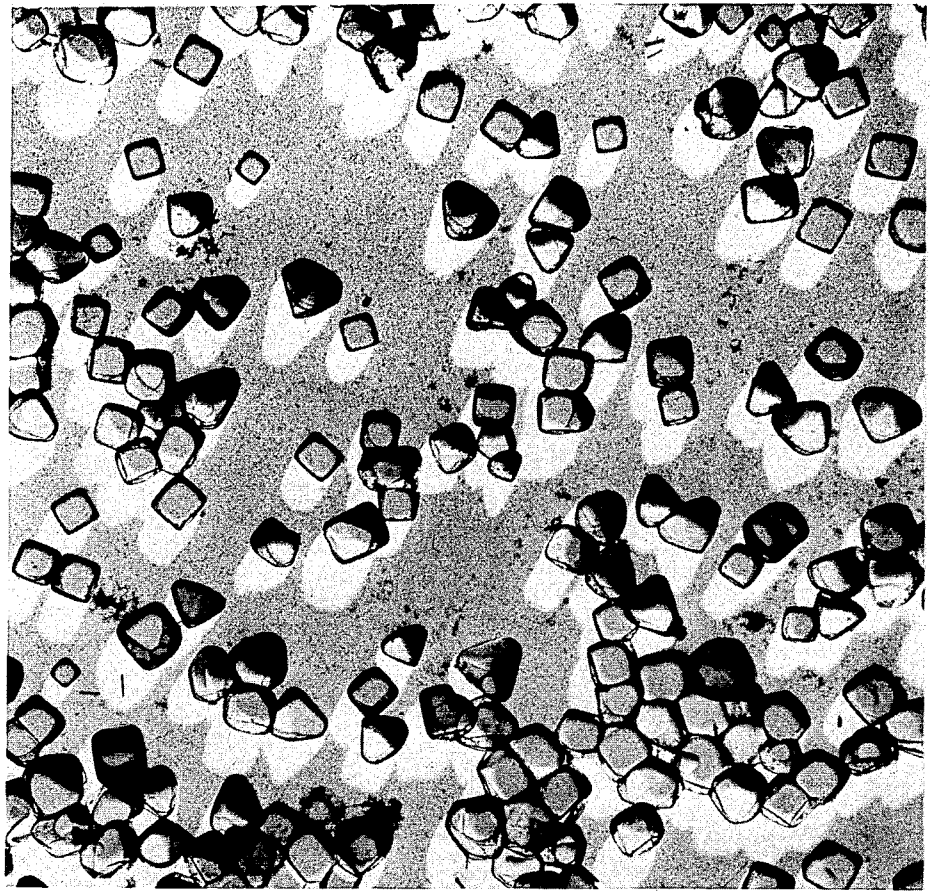
Figure 7:
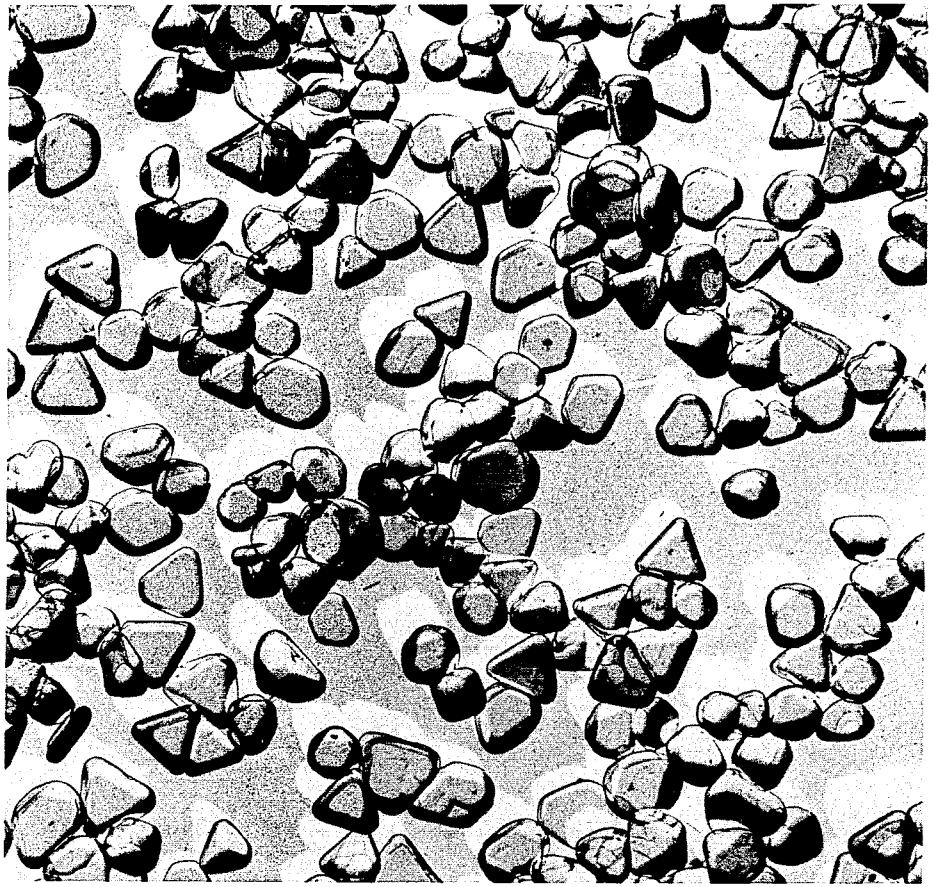

According to a particular aspect of the present invention there is provided a process for the production of a monosized silver halide emulsion of the twinned type which comprises steps (a), (b), (c), (d) and (e) as hereinbefore set forth and wherein in step (d) there is added further aqueous solutions of silver nitrate and ammonium or alkali metal halide at such a rate to the twinned crystals that no further nucleation of crystals occurs, the pAg being maintained at a fixed value in the range 5–12, and at a fixed temperature in the range of 35°–90° C. The selection of the pAg value depends on the crystal habit required, for example FIG. 6 shows the resulting twinned cubic crystals formed when the emulsion is prepared with growth step (d) effected at a pAg value of 6.0. The monodispersity of this twinned cubic emulsion as shown in FIG. 6 is particularly high. FIG. 7 shows an example of the corresponding emulsion produced with the growth step (d) effected at pAg 10 and illustrates the preparation of a monosized twinned octahedral emulsion.

Preferably to obtain twinned monosized octahedral emulsions step (d) is carried out at a fixed pAg between 9 and 11. Preferably to obtain twinned monosized cubc emulsions step (d) is carried out at a fixed pAg between 6 and 9 and at an ammonia concentration within the range 0 to 0.5 molar.

Figure 2:
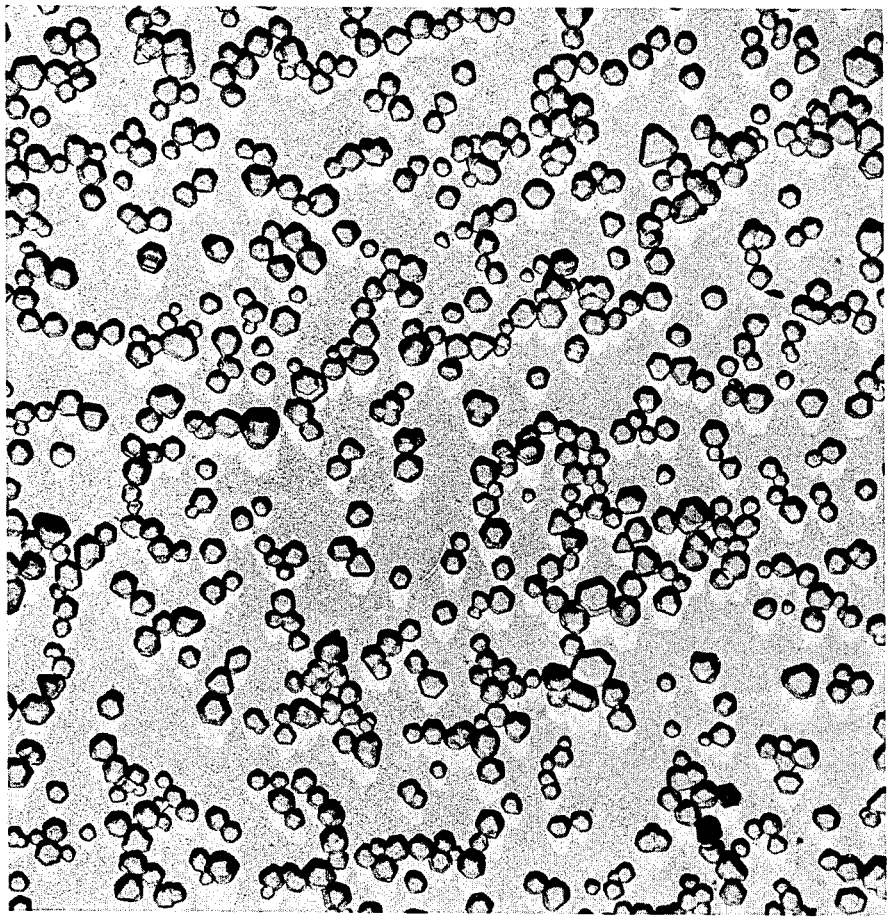

Preferably in order to produce monosized emulsions using the process of this invention the silver iodide emulsion prepared in step (a) is itself of the monosized type. Such emulsions may be prepared by the mixing of aqueous solutions of a silver salt and an alkali metal or ammonium iodide in a stirred solution of a protective colloid, at a fixed temperature and pAg. The final crystal size of the silver iodide emulsion is preferably in the range 0.05–0.50 micron. The halide solution is preferably ammonium iodide alone, but up to approximately 10 mole % of ammonium chloride or bromide may be used. In order that conveniently high rates of addition may be employed, the temperature of preparation is preferably at least 60° C., and the pAg of the solution is maintained at a controlled value in the range 3–5 or in the range 11–13. Most preferably the pAg is maintained at a value of approximately 11.8±0.3. FIG. 2 shows a silver iodide emulsion of this type. The pAg value may be maintained most conveniently by a suitable electrode system and automatic adjustment to the flow rate of one of the solutions.

The water-soluble salts formed during the process of the present invention may be removed by any of the well known methods. Such methods often involve coagulating the silver halide and colloid dispersing agent, removing this coagulum from the then aqueous medium, washing it and redispersing it in water. The fully grown silver halide crystals may be chemically sensitised by any of the well known means for example by use of sulphur, selenium and noble metals. Examples of suitable sensitising compounds are sodium thiosulphate and mercury, gold, palladium and platinum salts.

The emulsions prepared by the process of the present invention may be optically sensitised by the addition of optical sensitisers for example carbocyanine and merocyanine dyes to the emulsions.

The emulsions may contain any of the additives commonly used in photographic emulsions for example wetting agents, stabilising agents, polyethylene oxides, metal sequestering agents and growth or crystal habit modifying agents commonly used for silver halide such as adenine.

Preferably the dispersing medium is gelatin or a mixture of gelatin and a water-soluble latex for example a latex of a vinyl acrylate-containing polymer. Most preferably if such a latex is present in the final emulsion it is added after all crystal growth has occurred. However other water-soluble colloids for example casein, polyvinylpyrrolidone or polyvinyl alcohol may be used alone or together with gelatin.

The silver halide emulsions prepared according to the process of the present invention exhibit a desirably high covering power and contrast on development as shown in the Examples which follow.

The silver halide emulsions prepared according to the present invention thus are of use in many types of photographic materials such as X-ray films, camera films both black and white and colour, paper products and their use could be extended to other material for example direct positive materials.

Thus the invention includes silver halide emulsions prepared by the process of the present invention and coated photographic silver halide material containing at least one such emulsion.

The following Examples will serve to illustrate the invention.

EXAMPLE 1

Preparation of twinned octahedral silver iodobromide emulsion. Preparation of monosized silver iodide emulsion (step a)

Figure 8:
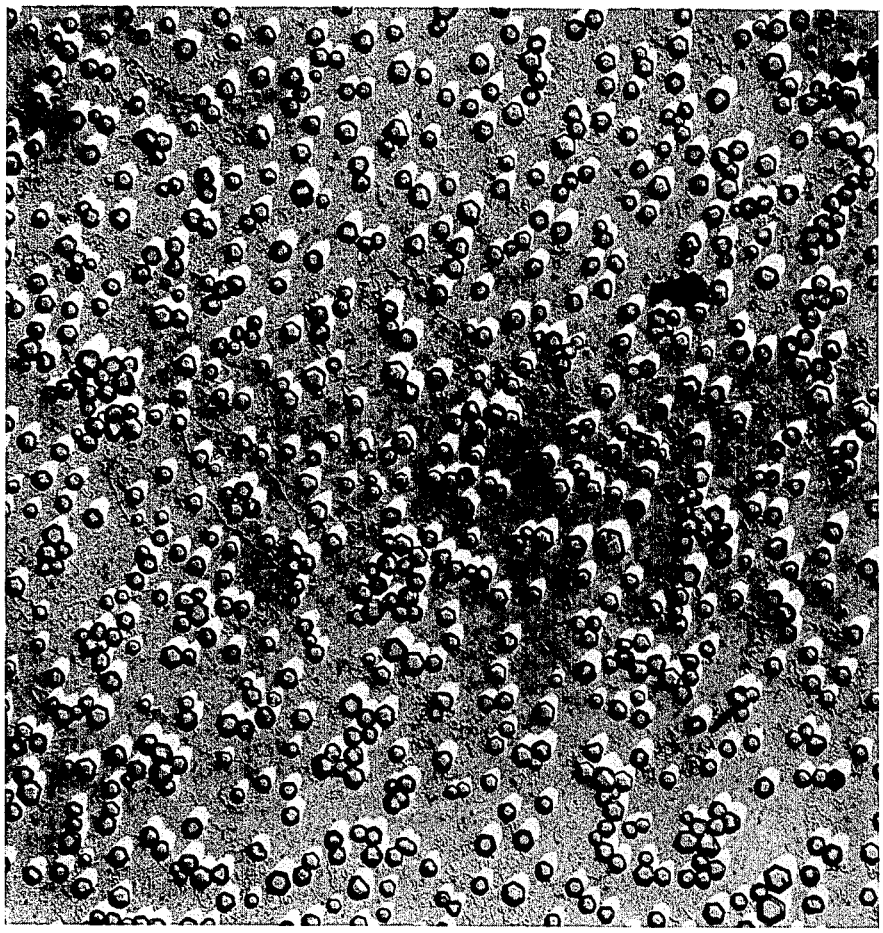

1 liter of 5% inert gelatin was stirred at 65° C. at 200 rpm with 0.2 ml tri-n-butyl orthophosphate as an antifoam. Aqueous 4.7 M solutions of silver nitrate and ammonium iodide were jetted into the stirred gelatin at 3000 ml per hour until 150 ml of silver nitrate solution had been added. Then further volumes of these solutions were added at 2100 ml per hour until 525 ml of silver nitrate solution had been added. The pAg of the emulsion was maintained throughout at a value of 11.8±0.2. The crystals of this silver iodide emulsion are shown in FIG. 8. They had a median crystal size of 0.18 micron.

Recrystallisation (step b)

230 g of this silver iodide emulsion were added to 1 liter of 5% inert gelatin, which was stirred at 65° C. at 200 rpm with 0.2 ml tri-n-butyl orthophosphate. Aqueous 4.7 M solutions of silver nitrate and ammonium bromide were jetted into the stirred silver iodide emulsion at 4200 ml per hour until 500 ml of silver nitrate had been added.

The pAg was maintained throughout at 6.0±0.5. Twinned octahedral silver iodobromide crystals were formed.

Ostwald ripening (step c)

The pAg of the emulsion prepared in step (b) was adjusted to 9.6. 180 ml of 11.8 molar ammonia solution (as silver halide solvent) were added, and stirring was continued during the Ostwald ripening. The temperature was maintained at 65° C. Rapid growth of tabular twinned crystals and substantially complete dissolution of the remaining untwinned crystals were achieved after 10 minutes ripening.

Further growth (step d)

The pH of the emulsion prepared in step (c) was adjusted to 5.0 with 5 N sulphuric acid so that the ammonia present was neutralised. Further 4.7 M solutions of silver nitrate and ammonium bromide were added to the emsulsion stirred at 200 rpm, with the temperature maintained at 65° C. and the pAg at 9.5, at a flow rate of 3000 ml per hour until 750 ml of silver nitrate had been added. The final emulsion had a median crystal size of 0.93 micron, and a coefficient of variation of 20%.

Figure 9:
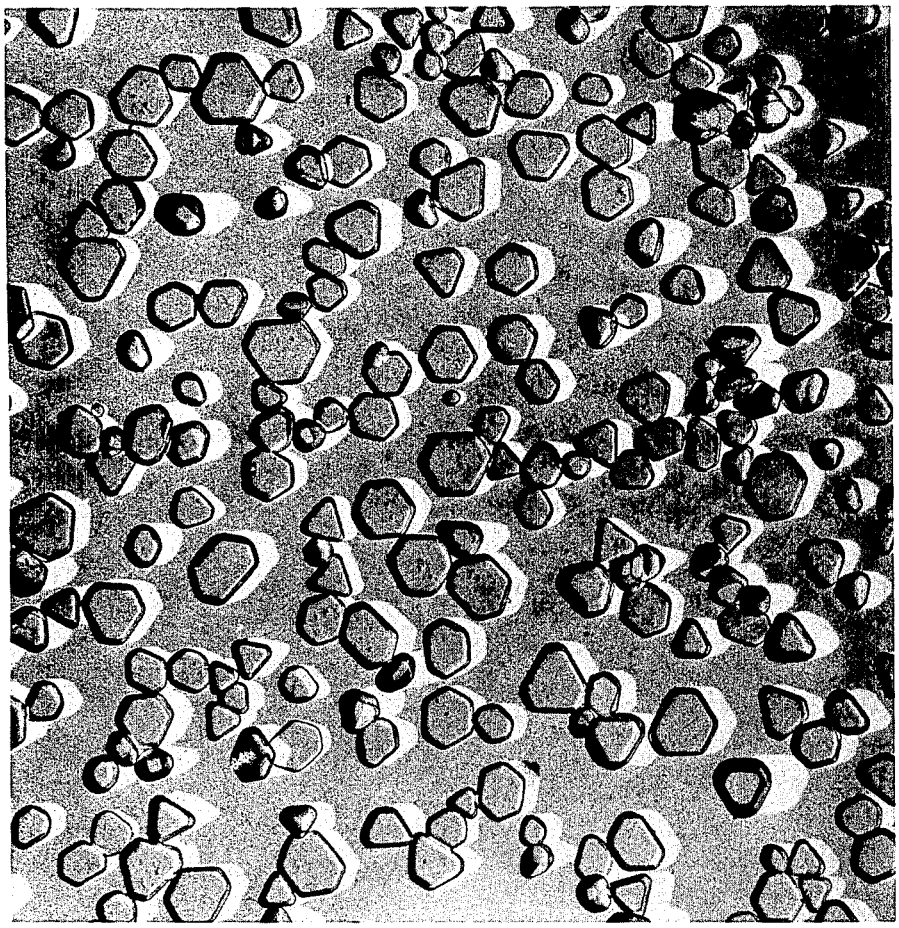

FIG. 9 shows the crystals of this final emulsion. It can clearly be seen from this electron micrograph that more than 50% of the crystals comprising the emulsion according to the present invention are of tubular twinned type.

Sensitisation of emulsion (step e)

The emulsion was flocculated using conventional techniques, washed and redispersed with a total of 210 g of limed ossein gelatin and then was digested at 57° C. for a range of times at pH 6.3 and pAg 8.8 in the presence of 4.2 mg of sodium thiosulphate and 0.6 mg of sodium tetrachloroaurate dihydrate per mole of silver halide.

The emulsion was stabilised using 7-hydroxy 5-methyl 2-methylthio 1,3,4 triazaindoline. The sensitised emulsion was then coated on to photobase at a coating weight of 40 mg Ag/dm$^2$.

Photographic results

The coated strips were then imagewise exposed for 0.2 seconds and developed for 4 minutes in a metol/hydroquinone based developer, at 20° C.

The photographic results obtained are shown in FIG. 10.

A fast camera speed silver iodobromide emulsion was used as a reference.

| EMULSION | SILVER COATING WEIGHT | $D_{MAX}$ | GAMMA (maximum contrast) |
|---|---|---|---|
| Emulsion of Example 1 (as prepared) | 40 mg/dm$^2$ | 2.1 | 1.31 |
| Fast camera | 41 | 1.4 | 0.81 |

The fast camera film used in this example is a commercial formulation made thus; 1.5 moles of 3 M silver nitrate solution were jetted into 2 liters of 1.5% gelatin solution containing 2.5 moles of 3 N ammonium bromide, 0.082 moles of 1.2 N potassium iodide and 3.07 moles of 11.8 N ammonia solution. After ripening the median linear size of the emulsion was 0.88 micron.

EXAMPLE 2

This example illustrates the preparation of an emulsion in which the recrystallisation and Ostwald ripening steps are combined, and in which twinned monosized cubic silver iodobromide crystals are prepared.

Preparation of twinned cubic silver iodobromide emulsion Preparation of monosized silver iodide emulsion (step a)

A monosized silver iodide emulsion was prepared according to step (a) of Example 1.

Recrystallisation and ripening (steps b and c)

230 g of the silver iodide emulsion prepared in step (a) were added to 1 liter of 5% inert gelatin, which was stirred at 200 rpm at 65° C. with 0.2 ml tri-n-butyl orthophosphate. Aqueous 4.7 M solutions of silver nitrate and ammonium bromide were jetted into the stirred silver iodide emulsion at the rate of 3000 ml per hour until 500 ml of silver nitrate had been added. The pAg was maintained throughout at 7.7±0.3.

Ostwald ripening was effected by the presence of 100 ml of 11.8 M ammonia solution, added with the halide solutions so that as recrystallisation of the silver iodide occurred, the concentration of ammonia increased. At the end of the addition of silver nitrate and ammonium halide solutions, dissolution of untwinned crystals by Ostwald ripening was substantially complete, and predominantly twinned crystals of silver iodobromide remained.

Further growth (step d)

The pH of the emulsion prepared in the combined steps (b) and (c) was adjusted to 5.0 with 5 N sulphuric acid. Further 4.7 M solutions of silver nitrate and ammonium bromide were added as follows, so that in total, 3000 ml of silver nitrate solution were added in this step;

| FLOW RATE | VOLUMES OF SOLUTIONS ADDED |
|---|---|
| 2400 ml/hr | 1000 ml |
| 4200 ml/hr | 2000 ml |

The pAg was maintained throughout at 6.0±0.5.

Figure 11:
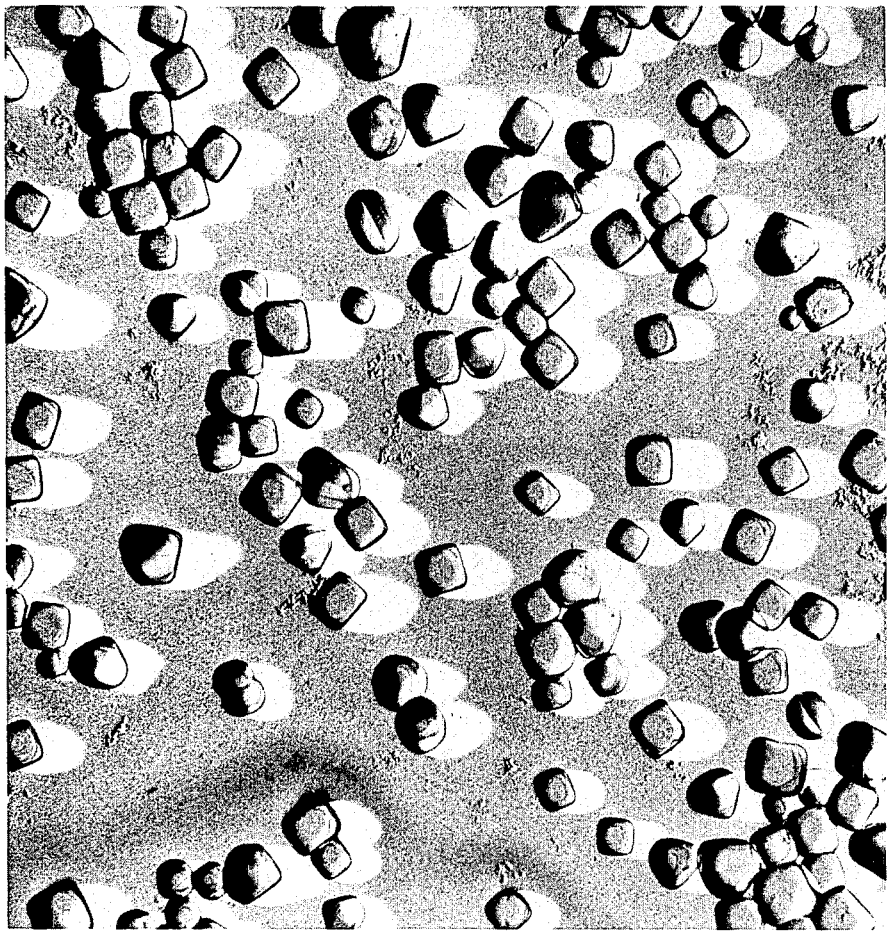

The final monosized emulsion had a median crystal size of 1.15 micron, and a coefficient of variation of 15%. FIG. 11 shows the crystals of the final emulsion. The two types of twinned cubic crystals, those containing parallel twin planes and those containing single twin planes respectively, can clearly be seen.

Sensitisation of emulsion (step e)

The emulsion was flocculated using conventional techniques, washed and redispersed with a total of 210 g of limed ossein gelatin and was then digested at 57° C. for a range of times at pH 6.3 and pAg 8.8 in the presence of 7 mg of sodium thiosulphate per mole of silver halide, and 0.6 mg of sodium tetrachloroaurate dihydrate per mole of silver halide. The emulsion was stabilised using 7-hydroxy 5-methylthio 1,3,4 triazaindoline. The sensitised emulsion was then coated on to photobase strips at a coating weight of 40 mg Ag/dm$^2$.

Photographic results

The coated strips were imagewise exposed for 0.2 seconds and developed in a metol/hydroquinone based developer, at 20° C. The photographic results are also shown in FIG. 10, compared with a fast camera speed emulsion used as a reference.

| EMULSION | SILVER COATING WEIGHT | $D_{MAX}$ | GAMMA |
|---|---|---|---|
| Emulsion of Example 2 | 40 mg/dm$^2$ | 1.7 | 1.09 |
| Fast camera | 41 mg/dm$^2$ | 1.4 | 0.81 |

EXAMPLE 3

This Example illustrates the preparation of an emulsion in which twinned monosized silver iodochlorobromide crystals of the intermediate tetradecahedral habit are prepared.

Preparation of monosized silver iodide emulsion (step a)

A monosized silver iodide emulsion was prepared according to step (a) of Example 1.

Recrystallisation and Ostwald ripening (steps b and c)

230 g of the silver iodide emulsion prepared in step (a) were added to 1 liter of 5% inert gelatin, which was stirred at 65° C. at 200 rpm with 0.2 ml tri-n-butyl orthophosphate. Aqueous 4.7 M solutions of silver nitrate and of a mixture of 4.7 M ammonium bromide and chloride solutions in the molar ratio of 66:34 were jetted into the stirred silver iodide emulsion at 9000 ml per hour until 150 ml of silver nitrate solution had been added, and double-jetting was then continued at 3000 ml per hour until a further 300 ml of silver nitrate solution had been added. The pAg was maintained throughout at 7.7±0.3.

100 ml of 11.8 molar ammonia solution were added with the halide solutions as silver halide solvent (as in Example 2).

Further growth (step d)

The pH of the emulsion prepared in the combined steps (b) and (c) was adjusted to 5 with 5 N sulphuric acid. Further 4.7 M solutions of silver nitrate and of ammonium bromide and chloride in the molar ratio 66:34 were added as follows:

| FLOW RATE | VOLUMES OF SOLUTIONS ADDED |
|---|---|
| 3600 ml/hr | 500 ml |
| 5400 " | 1000 |
| 7800 " | 1334 |

The pAg was maintained throughout at 8.6±0.3.

Figure 12:
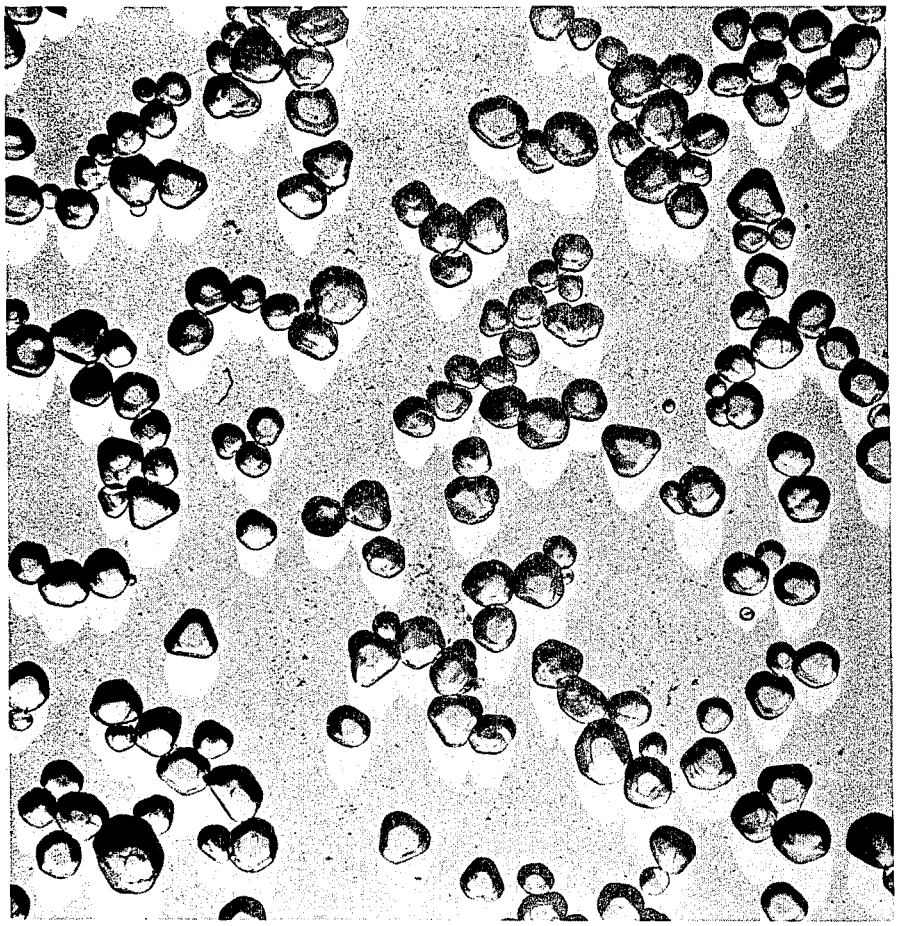

FIG. 12 shows the crystals of the final monosized emulsion, which had a mean linear crystal size of 0.97 micron, and a coefficient of size variation of 20%. It can clearly be seen that the twinned silver iodochlorobromide crystals of the emulsion produced were mainly of the intermediate, tetradecahedral habit.

Sensitisation of emulsion (step e)

The emulsion was flocculated using conventional techniques, washed and redispersed with a total of 210 g of limed ossein gelatin, and was then digested at 52° C. for a range of times at pH 5.6 and pAg 7.9 in the presence of 7.0 mg of sodium thiosulphate and 1.2 mg of sodium tetrachloroaurate dihydrate per mole of silver halide. The emulsion was stabilised using 7-hydroxy 5-methylthio 1,3,4 triazaindoline. The sensitised emulsion was then coated on to photobase strips at a coating weight of 40 mg Ag/dm$^2$.

Photographic results

The coated strips were imagewise exposed for 0.2 seconds and developed in a metol/hydroquinone based developer, at 20° C.

The photographic results are also shown in FIG. 10, compared with the fast camera speed emulsion used as a reference.

| EMULSION | SILVER COATING WEIGHT | $D_{MAX}$ | GAMMA |
|---|---|---|---|
| Emulsion of example 3 (as prepared) | 40 mg/dm$^2$ | 2.0 | 1.80 |
| Fast camera | 41 | 1.4 | 0.81 |

Discussion of Photographic Results

The photographic results of the emulsions prepared in Examples 1 to 3 show that they are of high photographic sensitivity, exhibit high covering power and high contrast.

What we claim is:

1. A method of preparing a silver halide emulsion containing silver halide crystals of the twinned type which comprises the steps of (a) forming, in a colloid dispersing medium silver, halide crystals containing at least 90 mole % iodide, (b) mixing in the dispersing medium containing the said silver halide crystals an aqueous solution of a silver salt and a aqueous solution of an alkali metal or ammonium bromide or chloride or mixtures thereof so forming twinned silver halide crystals containing iodide and the halide being added, (c) adding a silver halide solvent to the dispersing medium and so causing the growth of the twinned crystals by Ostwald ripening and optionally (d) then causing the twinned crystals to increase in size by adding to the colloidal dispersion further aqueous silver salt solution and further alkali metal or ammonium halide and then finally optionally (e) removing the water-soluble salts formed and chemically sensitising the emulsion.

2. A method according to claim 1 wherein the final emulsion is of the twinned octahedral type.

3. A method according to claim 1 wherein the final emulsion is of the twinned cubic type.

4. A method according to claim 1 wherein the silver iodide content in the dispersing medium at the commencement of step (b) is in the range of 0.05 to 2.0 moles/liter.

5. A method according to claim 4 wherein the silver iodide content in the colloid dispersing medium at the commencement of step (b) is in the range of 0.10 to 1.0 mole/liter.

6. A method according to claim 1 wherein the median linear size of the silver iodide crystals formed in step (a) is within the range of 0.05 to 0.5 microns.

7. A method according to claim 6 wherein the median linear size of the silver iodide crystals is within the range of 0.1 to 0.4 microns.

8. A method according to claim 1 where in step (b) aqueous 3–5 M solutions of silver nitrate and ammonium bromide or ammonium chloride are added to a stirred dispersion of silver iodide in gelatin solution, at a fixed temperature and pAg maintained in the range of 5.0 to 11.0.

9. A method according to claim 8 wherein the pAg range is from 6.0 to 10.0.

10. A method according to claim 8 wherein the temperature is maintained at a fixed value between 35° to 90° C.

11. A method according to claim 1 where in step (b) the flow rate of the silver salt is maintained constant as predetermined by experiment.

12. A method according to claim 1 where in step (b) the volumes of silver salt and ammonium or alkali metal halides are added such that the silver iodide comprises from 0.01 to 20 mole % of the total silver halide in the final emulsion.

13. A method according to claim 1 where in step (c) the silver halide solvent is excess halide salt, ammonia or ammonium thiocyanate.

14. A method according to claim 1 wherein step (c) is carried out in conditions favouring the octahedral habit in that ammonia added to a final concentration of 0.1 to 1.5 M is used as the silver halide solvent, the temperature is between 50° and 70° C. and the pAg is within the range of 7–10.

15. A method of preparing a monosized silver halide emulsion of the twinned type according to claim 1 which comprises steps (a), (b), (c), (d) and (e) where in step (d) there is added further aqueous solutions of silver nitrate and ammonium or alkali halide at such a rate to the twinned crystals that no further nucleation of crystals occurs, the pAg of the solution being maintained at a fixed value in the range 5–12, and the temperature of the solution being maintained constant in the range 35°–90° C.

16. A method according to claim 15 wherein the silver iodide emulsion prepared in step (a) is of the monosized type, and the median size of the silver iodide crystals is in the range of 0.05 to 0.5 microns.

17. A method according to claim 16 where in step (a) the temperature is maintained at least at 60° C. and the pAg in the range of 11 to 13.

18. A method according to claim 15 wherein the monosized silver halide emulsion is of the twinned octahedral type, step (d) being carried out at a fixed pAg between 9 and 11.

19. A method according to claim 15 wherein the monosized silver halide emulsion is of the twinned cubic type, step (d) being carried out at a fixed pAg between 6 and 9 and at an ammonia concentration within the range of 0 to 0.5 molar.

20. A silver halide emulsion prepared by the method of claim 1.

21. Photographic silver halide material which comprises at least one silver halide emulsion according to claim 20.

* * * * *